US005622522A

United States Patent [19]

Tan et al.

[11] Patent Number: 5,622,522

[45] Date of Patent: Apr. 22, 1997

[54] SHIELDED ELECTRICAL CONNECTOR

[75] Inventors: Haw-Chan Tan, Diamond Bar, Calif.; Chin T. Lai, Tao-Yuan Hsien, Taiwan

[73] Assignee: Hon Hai Precision Ind. Co., Ltd., Taiwan

[21] Appl. No.: 514,492

[22] Filed: Aug. 11, 1995

[51] Int. Cl.[6] ..... H01R 13/648

[52] U.S. Cl. ..... 439/607

[58] Field of Search ..... 439/607, 608, 439/609, 610, 660

[56] References Cited

U.S. PATENT DOCUMENTS 5,052,949 10/1991 Lopata et al. ..... 439/610

5,409,400 4/1995 Davis ..... 439/610

*Primary Examiner*—Neil Abrams

*Assistant Examiner*—Yong Kim

[57] ABSTRACT

An electrical connector (10) for use within an I/O card comprises an insulative elongated housing (12) defining a cavity (20) therein and a board (24) horizontally projecting within the cavity (20) for engagement with a protrusion portion of a cable connector. A shield (32) generally surrounds most portions of the periphery of the housing (12) with a portion of the shield (12) penetrating the housing (12) into the cavity (20) for electrically connecting to a shielding shell of the cable connector. A pair of latches (56) are received within two corresponding recesses (54) oppositely facing to each other by two sides of the cavity (20). The latch (56) further comprises a rearward projecting extension (66) having a step-like leg (68) downward extending adjacent to the end of the extension (66) for adjustable compliance with the different PC boards (72) which the I/O connector (10) is attached to and electrically engaged with.

19 Claims, 3 Drawing Sheets

SHIELDED ELECTRICAL CONNECTOR

BACKGROUND OF THE INVENTION

1. Field of the Invention

The invention relates to the connector for use within the I/O card, particularly to the whole structure of the connector providing shielding, grounding and latching functions therewith.

2. The Prior Art

I/O cards and/or memory cards are more and more popularly utilized in the computer industry. U.S. Design Pat. No. 351,136 discloses a miniaturized I/O connector for use within an I/O card and being adapted to engage a complementary cable connector, which may be referred to U.S. Design Pat. No. 351,135 and is generally connected to a periphery such as a modem.

The connector device as disclosed in Design Pat. No. 351,136 lacks not only grounding means for reliably and efficiently forming a grounding path between the shielding shell of the I/O connector and the shielding shell of the cable connector, but also properly and easily loaded latching means for releasably securing the complementary cable connector thereto.

An object of the invention is to provide an I/O connector which may be used within an I/O card for engagement with a complementary cable connector connected to a periphery, wherein the I/O connector is provided with proper grounding means for electrically connection to the cable connector which is substantially received within the I/O connector.

Another object of the invention is to provide an I/O connector having latching means which is conveniently and properly loaded thereto for releasably locking the complementary cable connector thereto for assuring a reliable full connection therebetween.

Yet an object of the invention is to provide an I/O connector, the latching means of which also functions as mounting orientation means for adjustably attaching the I/O connector to a PC board which is substantially embedded within the I/O card and has circuit traces thereon for soldering the contacts of the I/O connector thereto.

SUMMARY OF THE INVENTION

According to an aspect of the invention, an electrical connector for use within an I/O card comprises an insulative elongated housing defining a cavity therein and a board horizontally projecting within the cavity for engagement with a protrusion portion of a complementary cable connector. A shield generally surrounds most of the periphery of the housing with a portion of the shield penetrating the housing into the cavity for electrically connecting to a shielding shell of the cable connector. A pair of latches are received within two corresponding recesses oppositely facing to each other by two sides of the cavity.

The latch further comprises a rearward projecting extension bar having a step-like leg downward extending adjacent to the end of the extension bar for adjustable compliance with the different PC boards which the I/O connector is attached to and electrically engaged with.

DETAILED DESCRIPTION OF THE PREFERRED EMBODIMENTS

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
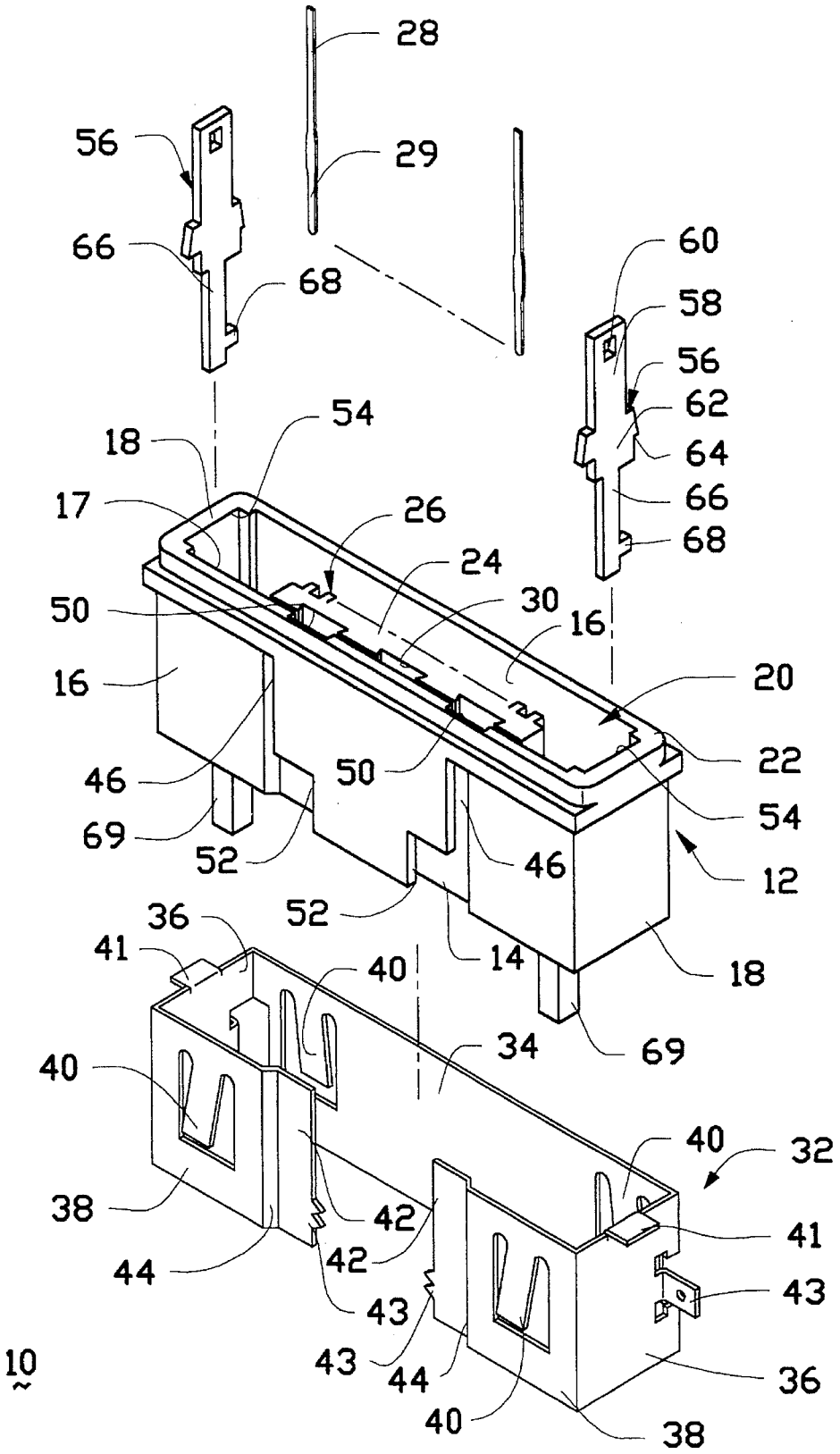
FIG. 1 is an exploded perspective view of an I/O connector of a presently preferred embodiment, according to the present invention.
Figure 2:
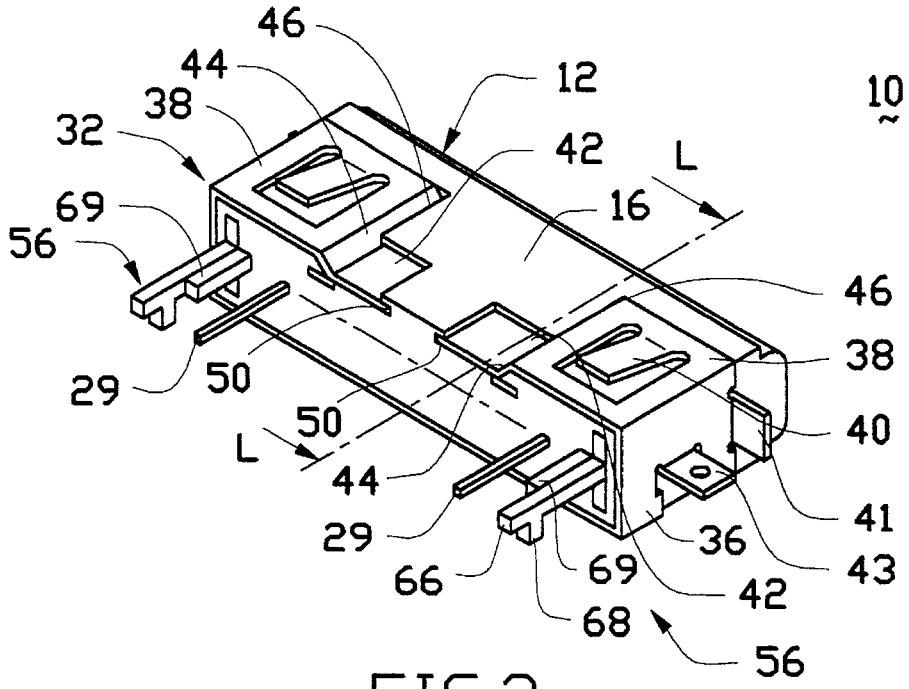
FIG. 2 is an assembled perspective view of the I/O connector of FIG. 1.
Figure 3:
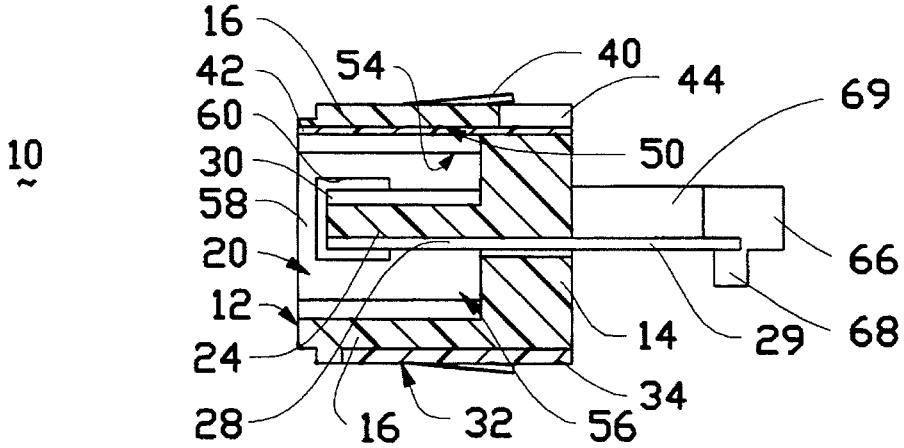
FIG. 3 is a cross-sectional view of the I/O connector of FIG. 2 along line L—L.

It will be noted here that for a better understanding, most of like components are designated by like reference numerals throughout the various figures in the embodiment. It is directed to FIGS. 1–3 wherein an I/O connector 10 comprises an insulative elongated housing 12 comprised of a rear wall 14, two opposite lengthwise walls 16 and two opposite side walls 18 commonly defining therein a cavity 20 facing the front surface 22 of the housing 12. In the cavity 20, a board 24 forwardly projects from the rear wall 14 and generally terminates flush with the surface 22 of the housing 12. A plurality of passageways 26 are side by side disposed on the under-surface of the board 24, and extend through the rear wall 14 whereby a corresponding number of contacts 28 are received within the corresponding passageways 26, respectively, with the tails 29 of the contacts 28 extending through the rear wall 14 and exposed in an exterior behind the rear wall 14.

Three keyways 30 are formed on the upper surface of the board 24 for selectively receiving at least key (not shown) therein for assuring correct connection with the right complementary cable connector (not shown).

Figure 5:
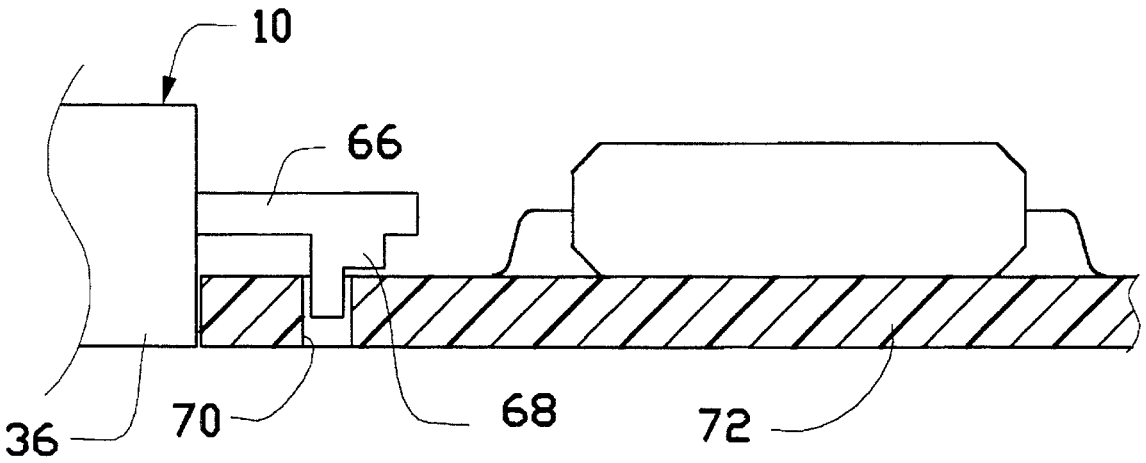
FIG. 5(A) is a partial side view of a second embodiment of an I/O connector having an adjustable mounting leg attached to the PC board having one side high profile components thereon.
FIG. 5(B) is a partial side view of the connector of FIG. 5(A) attached to the PC board having double sided low profile components thereon.
Figure 5:
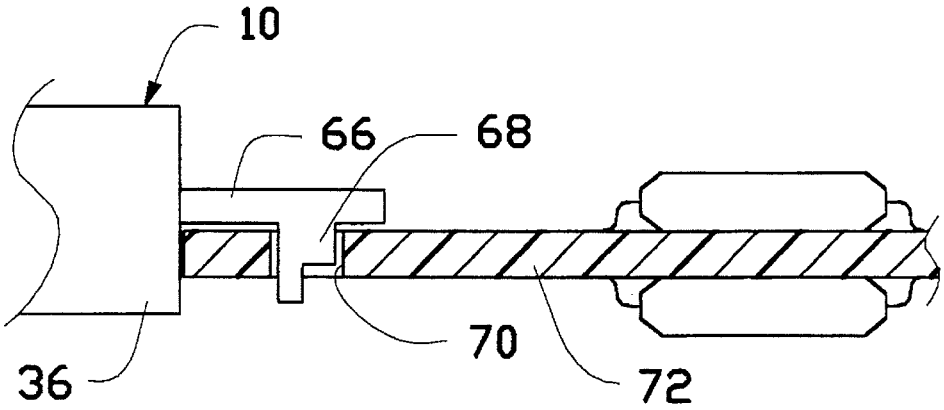

To surround the lengthwise walls 16 and the side walls 18 of the housing 12, a shield 32 made of a blank by stamping and forming, comprises a horizontal base 34, two side sections 36 integrally extending vertically from two opposite ends of the base 34,respectively, and two horizontal extensions 38 successively and integrally extending inwardly and horizontally from the ends of the side sections 36, respectively. Understandably, There are tangs 40 extending outward from the base 34 and the horizontal extensions 38 for electrically engagement with the shielding shell of the complementary cable connector (not shown). A vertical tag 41 and a horizontal tag 43 are positioned on each of the side sections 36 for contributorily controllably correctly positioning the housing 12 to the PC board 72 (FIG. 5). A grounding plate 42 integrally extends from each the horizontal extensions 38 via an offset section 44 whereby the grounding plate 42 is substantially lower than the horizontal extension 38.

Corresponding to the two offset sections 44 of the shield 32, one lengthwise wall 16 of the housing 12 comprises two slits 46 substantially penetrating such lengthwise wall 16 for allowing the offset sections 44 to be received therein, respectively. Moreover, corresponding to the two grounding plates 42, such lengthwise wall 16 further comprises two shallow channels 50 on its inner surface 17 extending in a front-to-end direction for respective reception of the grounding plate 42 therein. It can be understood that the depth of such shallow channel 50 is generally equal to the thickness of the grounding plate 42 such that the invading grounding plates 42 in the interior of the housing 12 can be properly embedded within such shallow channels 50 without invading the cavity 20 which must keep the designedly defined space for reception of the complementary cable connector. It is also seen that there are barbs 43 formed on the outermost edge of each of the grounding plate 42 which will engage with the corresponding portions of the housing 12 in the channel 50, so that the grounding plates 42 of the shield 32 can be interferentially retained within the corresponding channels 50. Therefore, the shield 32 is securely combined to the housing 12 under a condition that the base 34 of the shield 32 covers one lengthwise wall 16 of the housing 12, two side sections 36 of the shield 32 respectively cover two side walls 18, two horizontal extensions 38 respectively cover portions of another lengthwise wall 16 with each offset section 44 received within the corresponding slit 46 and each grounding plate 42 embedded with the corresponding channel 50. To inspect and ease assembling the shield 32 to the housing 12, two square openings 52 are formed in the lengthwise wall 16 adjacent to the rear wall 14 and in alignment with the channels 50, respectively.

Figure 4:
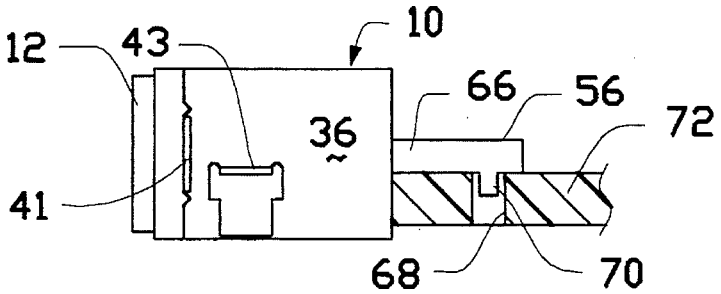
FIG. 4 is a side view of the connector of FIG. 2 oriented onto a PC board via the mounting leg of the latch.

The housing 12 further comprises a pair of latch-receiving recesses 54, facing to each other, formed on inner surfaces of the side walls 18 and beside the cavity 20. The recesses 54 extend from the front surface 22 and through the rear wall 16 of the housing 12 for receiving a pair of latches 56 therein, respectively. Each latch 56 comprises a strip type main body 58 having an orifice 60 approximate it front end for latchably engaging a protrusions of the complementary cable connector therein so that the connector 10 and the complementary cable connector can be secured together for preventing inadvertent disconnection therebetween. An expansion section 62 is positioned at the rear end of the main body 58 with barbs 64 disposed on one of the edge thereof for retaining the latch 56 within the corresponding recess 54. An extension bar 66 integrally extends rearward from the expansion section 64 and a leg 68 generally downward extends from proximate its distal end for engagement within a hole 70 of a PC board 72 (FIG. 4) which is enclosed in the I/O card and the connector 10 is attached to. To assist positioning the connector on the PC board 72, a pair of supports 69 integrally extend rearward from the rear wall 14 of the housing 12.

It can be noted that one feature of the present invention is that different from the prior art whose outer shell substantially surrounds all the periphery of the insulative housing, the shield 32 of this invention only covers most of outer surfaces of the insulative housing 12 but with portions of the shield 32 invading the interior of the housing 12 and communicating with the cavity 20 for direct contact with the other shell of the complementary cable connector for consideration of grounding. It is appreciated that in comparison with the exterior base 34, side sections 36 and horizontal extensions 38 of the shield 32 all of which may be deemed as the outer shield, such grounding plates 42 of the shield 32 also function as an inner shield to the contacts 28 of the connector 10, and such inner shield only incorporates a portion of the lengthwise wall where is not covered by the outer shield. Thus, there will no redundant arrangement of the shield 32 of this invention from a view of shielding consideration. Moreover, the retention means, i.e., barbs 43, of the shield 32 with regard to the housing 12 is arranged within the interior of the housing 12 such that the shield 32 may not be easily detached from the housing 12 in case of any external inadvertent rude touch. It can also be seen that corresponding to the features of the shield 32 in this invention, the housing 12 is required to form the slits 46 and channels 50 therein for receiving the corresponding offset sections 44 and the grounding plates 42 of the shield 32 therein, respectively.

Further more, the invention also provides means functions as both latching device, i.e., orifice 60, (to the complementary cable connector) and mounting device, i.e., leg 68, (to the PC board 72) without increasing the original dimension of the connector 10.

FIGS. 5(A) and 5(B) illustrate the connector 10 of the second embodiment which has a step type leg 68 on each of its latch 56 in compliance with the different type PC boards 72 having different type components mounted thereon. Using such step type leg 68 may adjust the vertical position of the connector 10 with regard to the PC board 72 in a range defined by the I/O card specification. Understandably, the positions of the vertical tags 41 and the horizontal tabs 43 may be varied to comply with the different two applications of the step type leg 68.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. An I/O input/output connector within an I/O card for engagement with a complementary cable connector, comprising:

an insulative housing comprising a plurality of walls defining a cavity therein;

a board horizontally extending in said cavity;

a plurality of contacts disposed on said board;

a shield generally surrounding most portions of the housing with some portions of said shield penetrating at least a first wall of the housing to invade an interior of the housing and to be adapted to communicate with the cavity.

2. The I/O connector as described in claim 1, wherein at least a slit is formed in said first wall for allowing the passage of the corresponding portion of the shield.

3. The I/O connector as described in claim 1, wherein the portion of the shield which invade the interior of the housing is a grounding plate, and a shallow channel is formed on an inner surface of the corresponding first wall for receiving said grounding plate therein.

4. The I/O connector as described in claim 3, wherein said grounding plate further includes retention means thereof for being interferentially engaged within the channel.

5. The I/O connector as described in claim 3, wherein said grounding plate also functions as an inner shield in comparison with the rest of other portions of the shield which function as an outer shield, and said inner shield and said outer shield are arranged not to substantially overlap to the corresponding first wall which the inner shield and the outer shield are applied thereto.

6. The I/O connector as described in claim 1, wherein said housing includes a rear wall, a pair of lengthwise wall and two side walls, and the first wall is one of said lengthwise wall.

7. The I/O connector as described in claim 6, wherein said shield includes a horizontal base, two side sections respectively vertically extending from two opposite ends of said base, two horizontal extensions respectively horizontally extend from said two side sections, two offset sections respectively extend from said two horizontal extensions, and two grounding plates respectively extend from said two offset sections whereby said two grounding plates substantially invade the interior of the housing.

8. The I/O connector as described in claim 7, wherein a vertical tag and a horizontal tag are disposed on each of the side sections of the shield.

9. The I/O connector as described in claim 7, a plurality of tangs extend outward from the base and the horizontal extensions.

10. The I/O connector as described in claim 1, wherein said connector further includes at least a latch having a main body with retention means thereon for latchable engagement with the complementary cable connector, and an extension bar with a leg thereon for orientation on a PC board which is received in said I/O card.

11. A shield for use with a shielded connector, comprising:

main portions arranged in a configuration adapted to cover most portions of a periphery of the connector wherein said periphery is generally defined by a plurality of walls of said connector;

offset sections connected to said main portions to pass a slit in at least one wall of the connector; and grounding plates connected to said offset sections to invade an interior of the connector.

12. The shield as described in claim 11, wherein said grounding plates also function as an inner shield in comparison with main portions of the shield which function as an outer shield, and said inner shield and said outer shield are arranged not to substantially overlap with each other with regard to said corresponding wall of the connector which the outer shield and the inner shield are both applied to.

13. An electrical connector for connecting to a complementary connector, comprising:

an insulative housing having a cavity defined by wall means for receiving a shell of said complementary connector therein;

a plurality of contacts positioned within the housing and communicating with the cavity;

a shield, main portions of which generally enclose most portions of said wall means except a grounding portion of which enters an interior of the housing to be adapted to communicate with the cavity, said grounding portion connected to the main portions via an offset section which extends through an opening formed in said wall means of the housing.

14. The electrical connector as described in claim 13, wherein said housing further comprises an interior shallow channel for receiving the corresponding entering grounding portion.

15. An electrical connector for connecting to a complementary connector, comprising:

an insulative housing having wall means defining a cavity therein;

a plurality of contacts positioned in the housing and in communication with the cavity;

a latch having a main body positioned within the housing and an extension bar rearward extending out of the housing;

retention means disposed on the main body for latchable engagement with the complementary connector; and leg means disposed adjacent an end of the extension bar for mounting orientation to a PC board.

16. The electrical connector as described in claim 15, wherein the housing comprises a recess, facing to and communicating with the cavity, for receiving the main body of said latch therein.

17. The electrical connector as described in claim 16, wherein said latch further includes an expansion section having barbs thereon for interferentially retaining the latch in said recess.

18. The electrical connector as described in claim 16, wherein said housing includes a rear wall, and said recess extends through said rear wall for allowing the extension bar of said latch to rearward project therefrom.

19. The electrical connector as described in claim 15, wherein said leg includes step structure for compliance with different PC boards having different components mounted thereon.

* * * * *